US008020786B2

(12) United States Patent
Lo

(10) Patent No.: US 8,020,786 B2
(45) Date of Patent: Sep. 20, 2011

(54) SHOWER HEAD

(75) Inventor: James Chi-Wai Lo, Hong Kong (CN)

(73) Assignee: Lomak Industrial Co., Ltd., New Territories, Hong Kong (CN)

( * ) Notice: Subject to any disclaimer, the term of this patent is extended or adjusted under 35 U.S.C. 154(b) by 103 days.

(21) Appl. No.: 12/476,623

(22) Filed: Jun. 2, 2009

(65) Prior Publication Data

US 2009/0321538 A1 Dec. 31, 2009

(30) Foreign Application Priority Data

Jun. 2, 2008 (HK) ..... 08106133

(51) Int. Cl.
*B05B 3/04* (2006.01)

(52) U.S. Cl. ..... 239/237; 239/240; 239/263; 239/263.3; 239/381; 239/548; 239/567

(58) Field of Classification Search ..... 239/225.1, 239/237–240, 263, 236.3, 246, 280–389, 239/222.11–222.21, 443, 538, 548, 567, 239/561

See application file for complete search history.

(56) References Cited

U.S. PATENT DOCUMENTS

| | | | | |
|---|---|---|---|---|
| 5,009,368 | A * | 4/1991 | Streck et al. | 239/70 |
| 5,294,054 | A * | 3/1994 | Benedict et al. | 239/222.15 |
| 5,433,384 | A | 7/1995 | Chan et al. | |
| 6,412,711 | B1 | 7/2002 | Fan | |
| 2008/0111006 | A1 * | 5/2008 | Shieh | 239/383 |

* cited by examiner

*Primary Examiner* — Jason Boeckmann

(74) *Attorney, Agent, or Firm* — Buchanan Ingersoll & Rooney PC

(57) ABSTRACT

The present invention provides in an adjustable shower head having a user-operable variable spray pattern. The shower head includes an adjustment mechanism that is hydropowered by water passing through the shower head, upon activation by a user.

3 Claims, 7 Drawing Sheets

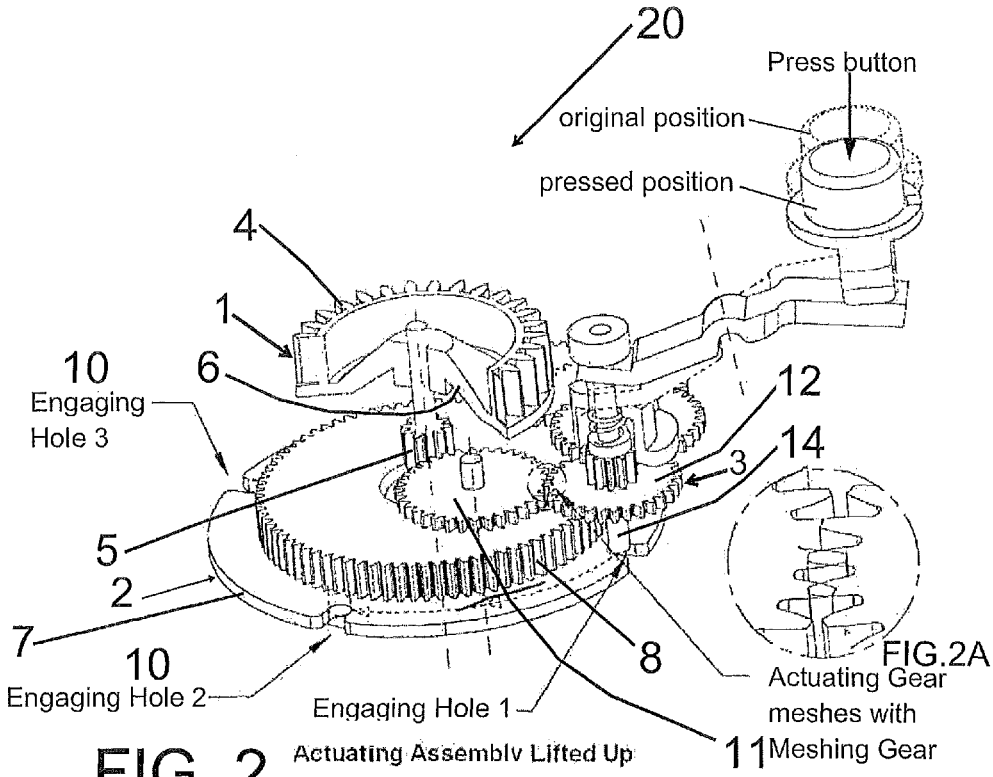
FIG. 2 Actuating Assembly Lifted Up
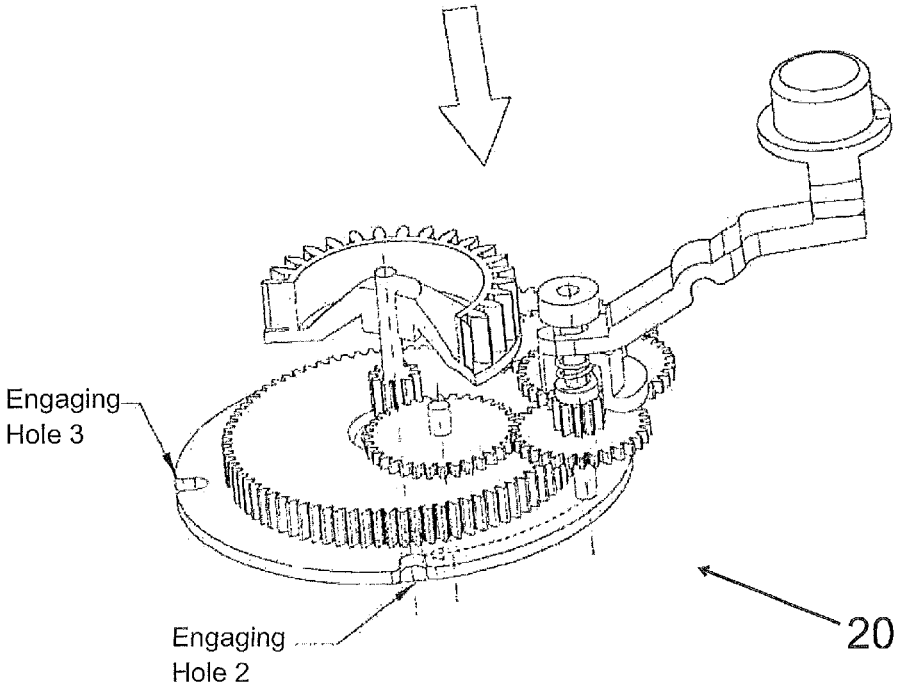
Nozzle Assembly driven to rotate FIG. 3

SHOWER HEAD

TECHNICAL FIELD

This invention relates to a shower head. In particular the invention is described with reference to a shower head that that has variable shower pattern that can easily be adjusted with a single hand of a user.

BACKGROUND

Shower heads with a variable spray pattern are known. Typically, the spray pattern is varied by rotating a portion of the shower head by hand. The spray pattern may be continuously variable, or with some shower head devices it is varied as discrete steps.

One such shower head device having discrete steps is one in which there are several spray pattern derived from several different aperture arrangements, such as fine, course, broad and no spray (water just passes through a single hole), as the periphery of the shower head is rotated by hand. The head is able to be clicked into place so that the chosen aperture arrangement is aligned with a delivery conduit, so that the water passes through the selected aperture arrangement.

A deficiency associated with this prior art is that for hand-held shower heads having a user adjustable spray pattern, to vary the spray pattern a user must use two hands to rotate the head to alter the spray pattern.

Attempts have been made to provide a shower head that can be adjusted by an actuating mechanism in a single handed operation. For example, U.S. Pat. No. 5,433,384(Chan et al) describes a push button controlled shower head where the push button moves a spring-biased pawl that bears against a ratchet wheel which is rotated through a predetermined arcuate step. The ratchet wheel moves a shutter which directs water into a selected one of several races, each race being associated with a spray pattern. Also in another arrangement U.S. Pat. No. 6,412,711(Fan) discloses an adjustable shower head, in which a knob is turned to rotate a mechanism to adjust the spray pattern. A user is able to turn the knob with their thumb, whilst holding the handle to continuously adjust the spray from a selection of spray patterns. However, one disadvantage with such "single-handed operation" shower heads, is that if the user is elderly, weak or infirm, they may have difficulty in adjusting the shower head spray pattern.

The object of the present invention is to provide a shower head that overcomes at least one of the problems associated with the prior art.

SUMMARY OF INVENTION

According to a first aspect the present invention consists in an adjustable shower head having a user-operable variable spray pattern, said shower head comprising an adjustment mechanism that is hydropowered by water passing through said shower head, upon activation by a user.

Preferably said shower head has an elongate body adapted to be connected to a water hose at its proximal end and a rotatable nozzle plate mounted at its distal end, the rotatable nozzle plate comprises a plurality of holes of the same or different size and shapes through which water passes to generate different water spray patterns.

Preferably said nozzle plate is driven to rotate by said hydropower generated by the water flowing through said body such that water spray patterns are changeable from one to another without exertions of force by the user.

Preferably said plurality of holes of the same or different sizes or shapes are continuously or discretely disposed circumferentially on the nozzle plate such that the rotation of the nozzle plate produces uniform spray patterns, or gradually or discretely changing spray patterns.

According to a second aspect the present invention consists in an adjustable shower head having a user-operable variable spray pattern, said shower head comprising a rotatable nozzle plate having a plurality of holes of the same or different sizes or shapes that are continuously or discretely disposed circumferentially on the nozzle plate such that the rotation of the nozzle plate produces uniform spray patterns, or gradually or discretely changing spray patterns, and said rotation of said nozzle plate is hydropowered by water being fed to said shower head.

Preferably said nozzle plate is normally locked in a stationary configuration, and by actuation of an adjustment mechanism by a user, said nozzle plate may be unlocked and allowed to be hydropowered into rotation.

According to a third aspect the present invention consists in a shower head with a mechanism for varying the spray pattern of water exiting there from, said mechanism comprising:

- a driving assembly having a waterwheel that extracts hydropower from water flowing through the shower head, a driving gear connected to said waterwheel via a shaft such that when sufficient water flow is passing through said shower head said driving gear is rotated about a longitudinal axis of said shaft as a result of said hydropower;
- a rotatable nozzle plate having a plurality of holes of the same or different size and shapes through which water passes to generate different water spray patterns, said nozzle plate having a plurality of spaced apart apertures disposed at or near its periphery and a nozzle gear fixedly mounted thereto; and
- an actuation gear assembly having an actuating gear fixedly mounted to a pin and biasedly urged towards said nozzle plate via a spring, and said actuation gear assembly movable by a push button mechanism; and in a normal configuration said pin engages with one of said plurality of spaced apart apertures disposed on the periphery of said nozzle plate, thereby holding said nozzle plate stationary; and wherein when said push-button mechanism is depressed by a user, a lever actuates the actuating gear such that said pin disengages said nozzle plate thereby allowing said nozzle plate to rotate, and said actuating gear causing meshing engagement between said nozzle plate and said driving gear, so that the rotation of said driving gear via said hydropower rotates said nozzle plate.

Preferably when said push-button actuation mechanism is released by said user the biased movement of the actuating gear will cause said nozzle plate to disengage from said driving gear and said pin to engage with one of said spaced apart plurality of apertures, thereby holding said nozzle plate stationary, and wherein each of the plurality of spaced apart apertures is associated with a different predetermined shower pattern.

Preferably said plurality of holes of the same or different sizes or shapes are continuously or discretely disposed circumferentially on the nozzle plate such that the rotation of the nozzle plate produces uniform spray patterns, or gradually or discretely changing spray patterns.

According to a fourth aspect the present invention consists in a shower head having a user-operable variable spray pattern, said shower head comprising an internally disposed drive assembly that is hydropowered by water passing through said shower head, and a rotatable nozzle plate having a plurality of holes of the same or different sizes or shapes that are continuously or discretely disposed circumferentially on the nozzle plate such that the rotation of the nozzle plate produces uniform spray patterns, or gradually or discretely changing spray patterns as said water passes therethrough, and wherein said nozzle plate is normally held in a locked configuration via a biased actuating gear assembly, and upon actuation of said biased actuating gear assembly by a user, said nozzle plate is able to be released from said locked configuration and be operably rotated by said drive assembly.

BRIEF DESCRIPTION OF DRAWINGS

FIGS. 2 and 2A depict a perspective view of the components of the adjustment mechanism of an adjustable shower head of FIG. 1 with the button depressed;

FIG. 3 depicts a perspective view of the components of the adjustment mechanism of an adjustable shower head of FIG. 1 where the nozzle assembly is being driven to rotate;

DESCRIPTION OF PREFERRED EMBODIMENTS

FIGS. 1 to 4 depict a first embodiment of the components of an adjustable shower head in accordance with the present invention. The shower head comprises an "adjustment mechanism" 20 having a drive assembly 1, a nozzle plate assembly 2 and an actuating gear assembly 3. In order to clearly see the internal components, the outer body of the shower head through which the water flows has been omitted.

Figures 1, 1A:
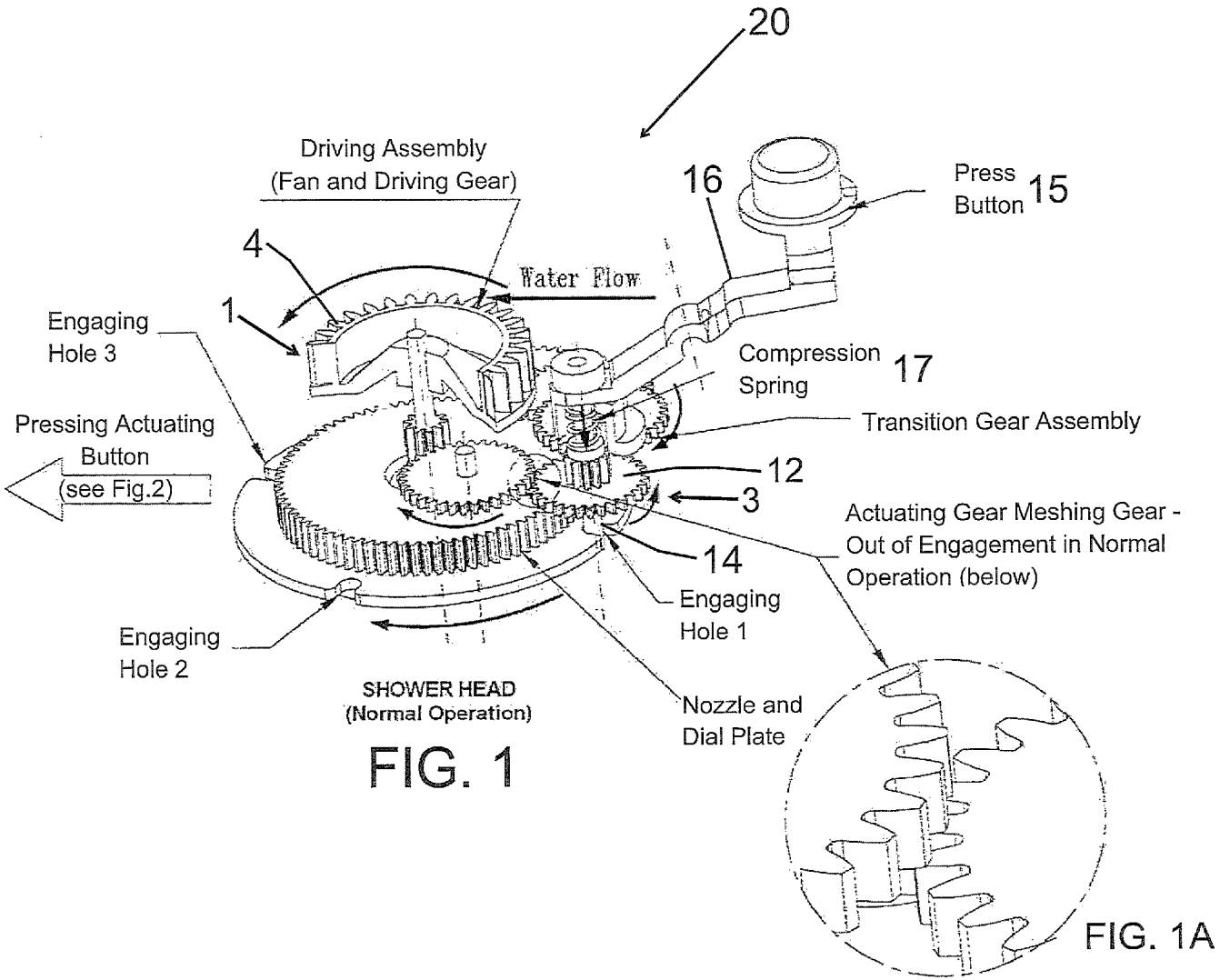
FIGS. 1 and 1A depict a perspective view of the components of a first embodiment of an adjustment mechanism of an adjustable shower head in accordance with the present invention in normal operation (where the user button is not depressed)

The drive assembly 1 includes a water wheel 4 and a driving gear 5 that are interconnected by a shaft 6. In FIGS. 1 to 3 a portion of the water wheel 4 is omitted so that other components can be clearly depicted. The water flowing through the body (not shown) of the shower head drives the water wheel 4 and hence the driving gear 5. Therefore, whenever sufficient driving water flow is supplied, the water wheel 4 extracts hydropower and thereby rotates driving assembly 1.

Nozzle plate assembly 2 comprises a nozzle plate 7 and a nozzle gear 8 fixedly mounted thereto. Nozzle plate 7 comprises a plurality of holes 9 for the water flow passing there through, and a plurality of spaced apart engaging apertures (slits) 10 at its periphery (see FIG. 4). Nozzle gear 8 is capable of meshing with a meshing gear 11.

The plurality of holes 9 in nozzle plate 7 are preferably of the same or different size and shapes in order generate different water spray patterns, as water passes there through.

The actuating gear assembly 3 comprises an actuating gear 12 fixedly mounted to a pin 14. Actuating gear assembly 3 is urged downwards by means of a compression spring 17. As a result, pin 14 of actuating gear assembly 3 engages with one of the plurality of engaging apertures 10 of nozzle plate 7. Hence the rotation of nozzle plate 7 is normally restricted (locked in a stationary configuration) by pin 14, as shown in FIG. 1. Actuating gear 12 is adapted to engage with meshing gear 11, which in turn meshes with nozzle gear 8.

When button 15 is pressed by a user as shown in FIG. 2, it actuates a lever 16 which lifts up actuating gear assembly 3. This disengages pin 14 from aperture 10 of nozzle plate 7, thereby allowing nozzle plate 7 to rotate. As a result of the elevation of actuating gear assembly 3, the actuating gear 12 now meshes with the rotating driving gear 5. Hence, actuating gear 12 starts to rotate which drives meshing gear 11, and ultimately the nozzle plate 7 to rotate, as shown in FIG. 3.

As the actuating gear assembly 3 is urged towards nozzle plate 7 by compression spring 17, the lifted pin 14 continues to be pressed against the nozzle plate 7 during the rotation of nozzle plate assembly 2, until it ultimately engages with another aperture 10 of the nozzle plate 7.

In use, when a user depresses(actuates) button 15, nozzle plate 7 is driven to rotate by hydropower generated by the water flowing through the body of the shower head, such that water spray patterns are changeable from one to another with minimal or no exertions of force by the user. Each of the plurality of spaced apart apertures 10 is associated with a different predetermined shower pattern, and therefore when nozzle plate 7 is rotated and pin 14 engages with the next aperture 10, the nozzle plate 7 is held stationary and the "predetermined shower pattern" associated with that next aperture 10 has been selected.

In the abovementioned embodiment, the shower head is preferably of the hand-held type having an elongate body (not shown) adapted to be connected to a water hose at its proximal end, with the rotatable nozzle plate 7 at its distal end. However, it should be understood that although the invention is most advantageous for hand-held type shower heads, the invention may also be implemented in shower head arrangements which are fixed to the wall of a shower recess.

The abovementioned embodiment is described with reference to an arrangement where the spray pattern is variable by rotation of the nozzle assembly 3, however in other not shown embodiments it is equally applicable for shower heads for which the spray pattern is altered in another manner such as sliding or moving a lever. In such a case, a linear type hydropowered actuator would be required to be used.

Figure 5:
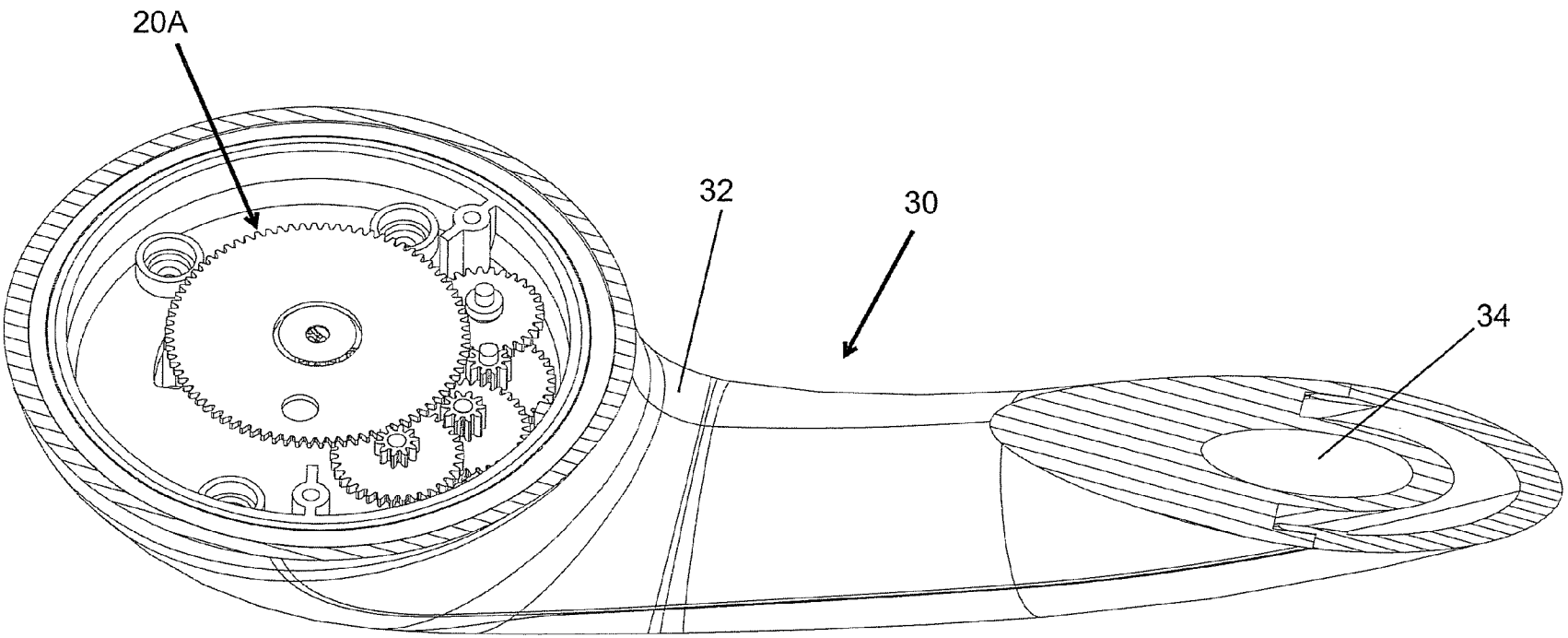
FIG. 5 depicts an underside partial perspective view of a first embodiment of an adjustable shower head in accordance with the present invention.
Figure 6:
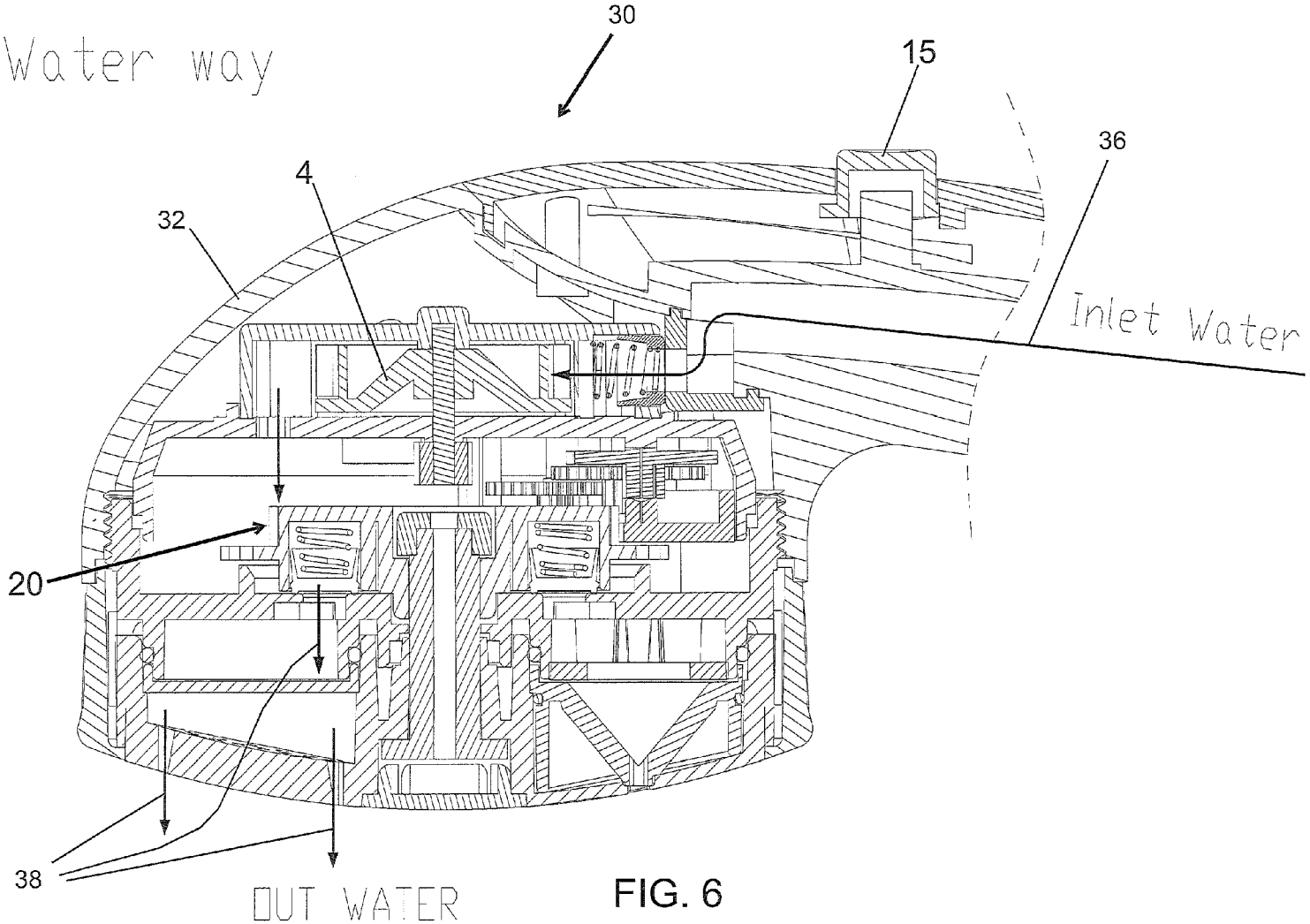
FIG. 6 depicts a partial cross-sectional view of the adjustable shower head of FIG. 5.

Referring to FIG. 5 and FIG. 6, there is depicted an embodiment of a hand held showerhead 30 in accordance with the present invention. The showerhead 30 includes a hand held housing 32 in which an adjustment mechanism 20 is housed.

Figure 4:
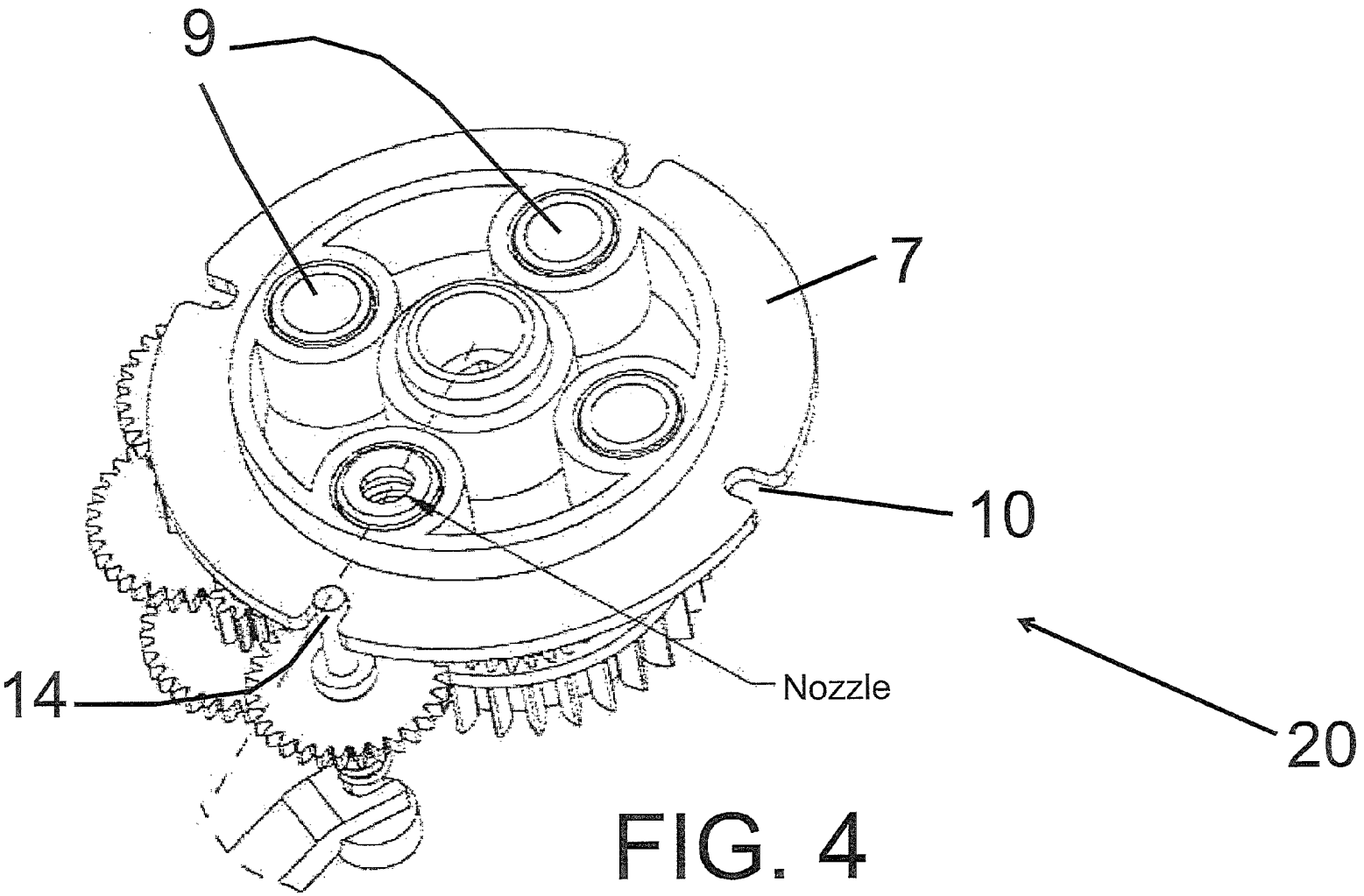
FIG. 4 depicts an underside perspective view of the components of the adjustment mechanism of an adjustable shower head of FIG. 1.

The embodiment of the adjustment mechanism 20 as depicted in the present embodiment is user operable and functions in a similar manner as described and depicted in relation to FIG. 1, FIG. 2., FIG. 3 and FIG. 4.

Water is introduced into the showerhead 30 via passage 34 as inlet water 36. The inlet water 36 flows through housing 32, driving waterwheel 4, which, upon user operable button 15 being depressed, causes operation of the adjustment mechanism 20 in a manner as described above, thus allowing user operable selection of a "predetermined shower pattern" as outlet water 38.

Figure 7:
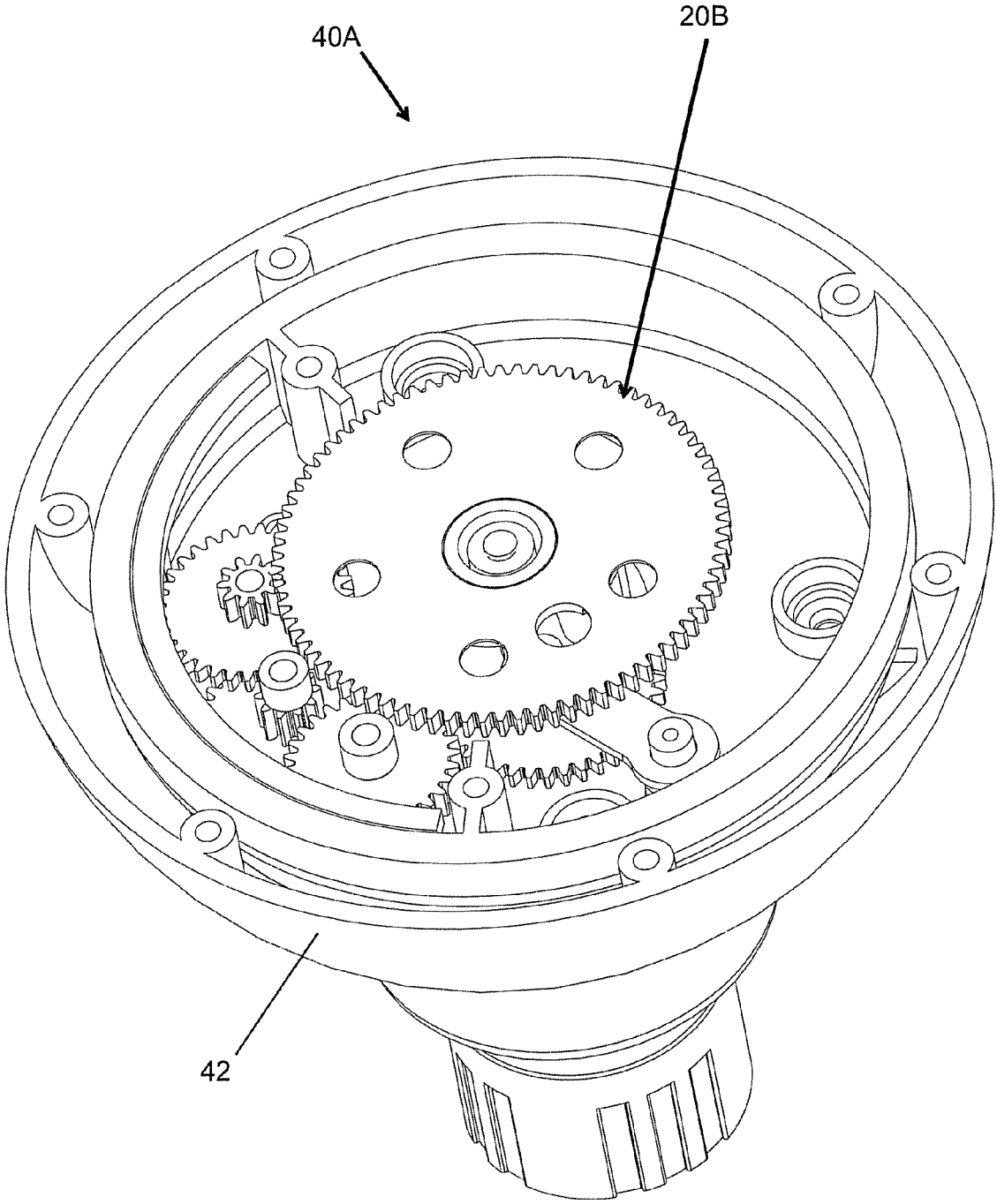
FIG. 7 depicts an underside partial perspective view of a second embodiment of an adjustable shower head in accordance with the present invention.
Figure 8:
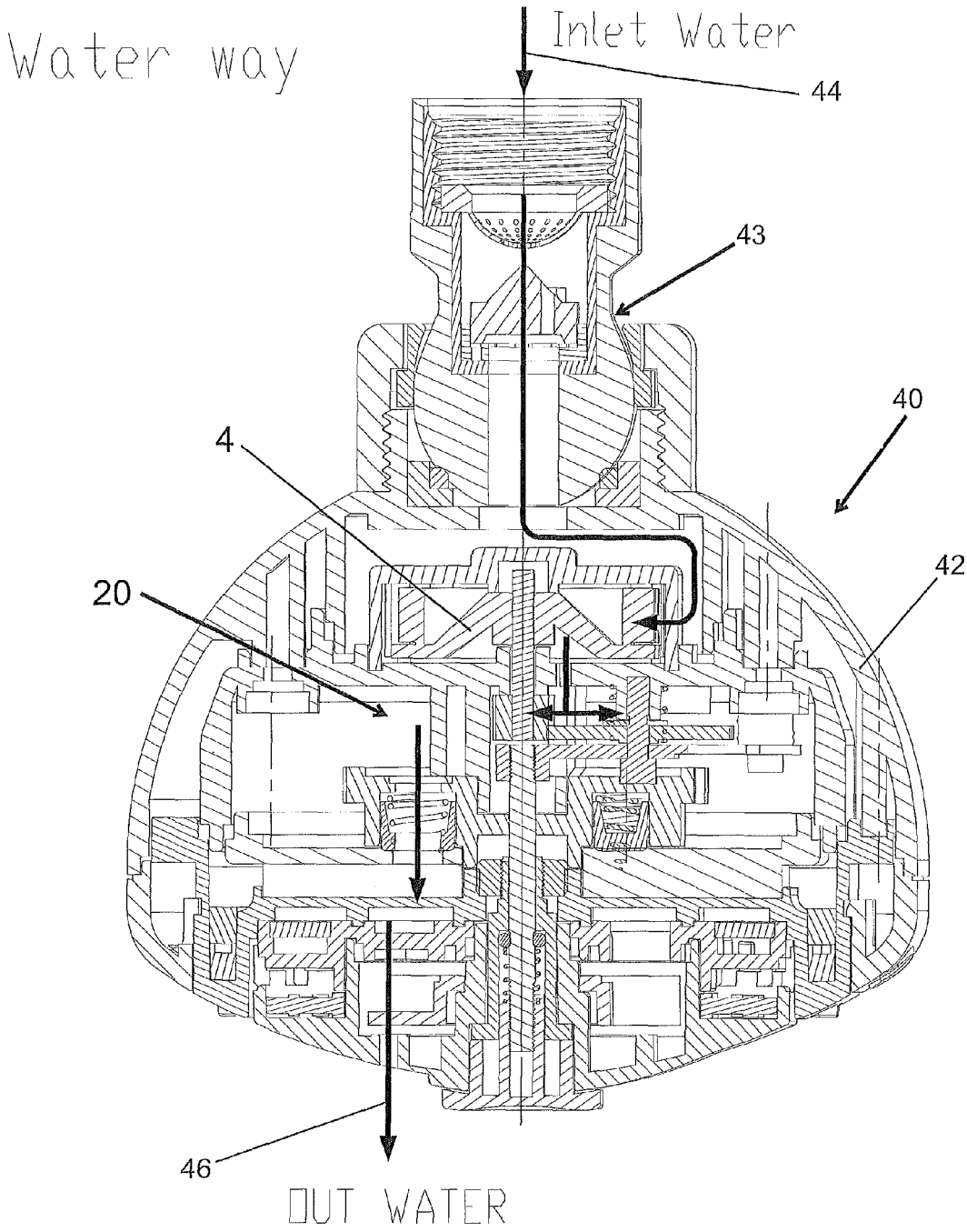
FIG. 8 depicts a cross-sectional view of the adjustable shower head of FIG. 7.

Referring to FIG. 7 and FIG. 8, there is depicted an alternate embodiment of a showerhead 40 in accordance with the present invention. The showerhead 40 is a non-hand held showerhead which may be attached to a permanent or semi-permanent fixture. The showerhead 40 includes a housing 42 in which an adjustment mechanism 20 is housed. The showerhead 40, includes an adjustable ball-joint mount mechanism 43, which allows the showerhead 40 to be adjustably mounted to a fixture or surface, such as a wall or ceiling.

The adjustment mechanism 20 again is operable in a manner similar as described in reference to FIG. 1, FIG. 2., FIG. 3 and FIG. 4 above. The inlet water 44 flows through housing 42, driving waterwheel 4, which, upon a user operable button (not shown) being depressed, causes operation of the adjustment mechanism 20 in a manner as described above, thus allowing user operable selection of a "predetermined shower pattern" as outlet water 46.

Advantageously, the embodiments as described with reference to the present invention, allow use selectable operation of desired or "predetermined shower pattern", without the necessity for a user to manually adjust the spray pattern , as required for traditional adjustable showerheads. Furthermore, utilising the "hydropower" provided by the water flow through the showerhead minimises the effort required by a user to adjust a showerhead.

When single hand operation is required, adjustment may be effected with minimal effort and single handed, which increases safety in particular for the elderly and the like, whilst not requiring full hand strength of younger subjects. Furthermore, in typical showering settings, soaps can increase the difficulty in adjusting a showerhead due to gripping reasons, the present invention obviating the necessity of force or rotational motion being required from a user in order to effect adjustment.

Those skilled in the art will appreciate that the adjustment mechanisms and showerheads described in reference to the drawings are exemplary embodiments of the invention, and that other adjustment mechanisms which allow a user-operable variable spray pattern to be selected by incorporating an adjustment mechanism that is hydropowered by water passing through the shower head upon activation by a user, are understood to fall within the scope of the present invention.

The terms "comprising" and "including" (and their grammatical variations) as used herein are used in inclusive sense and not in the exclusive sense of "consisting only of".

The invention claimed is:

1. A shower head with a mechanism for varying the spray pattern of water exiting there from, said mechanism comprising:

a driving assembly having a waterwheel that extracts hydropower from water flowing through the shower head, a driving gear connected to said waterwheel via a shaft such that when sufficient water flow is passing through said shower head said driving gear is rotated about a longitudinal axis of said shaft as a result of said hydropower;

a rotatable nozzle plate having a plurality of holes of the same or different size and shapes through which water passes to generate different water spray patterns, said nozzle plate having a plurality of spaced apart apertures disposed at or near its periphery and a nozzle gear fixedly mounted thereto; and an actuation gear assembly having an actuating gear fixedly mounted to a pin and biasedly urged towards said nozzle plate via a spring, and said actuation gear assembly movable by a push button mechanism; and in a normal configuration said pin engages with one of said plurality of spaced apart apertures disposed on the periphery of said nozzle plate, thereby holding said nozzle plate stationary; and wherein when said push-button mechanism is depressed by a user, a lever actuates the actuating gear such that said pin disengages said nozzle plate thereby allowing said nozzle plate to rotate, and said actuating gear causing meshing engagement between said nozzle plate and said driving gear, so that the rotation of said driving gear via said hydropower rotates said nozzle plate.

2. A shower head as claimed in claim 1, wherein when said push-button actuation mechanism is released by said user the biased movement of the actuating gear will cause said nozzle plate to disengage from said driving gear and said pin to engage with one of said spaced apart plurality of apertures, thereby holding said nozzle plate stationary, and wherein each of the plurality of spaced apart apertures is associated with a different predetermined shower pattern.

3. A shower head as claimed in claim 1, wherein said plurality of holes of the same or different sizes or shapes are continuously or discretely disposed circumferentially on the nozzle plate such that the rotation of the nozzle plate produces uniform spray patterns, or gradually or discretely changing spray patterns.

* * * * *